US009421769B2

(12) United States Patent
Owaki et al.

(10) Patent No.: US 9,421,769 B2
(45) Date of Patent: Aug. 23, 2016

(54) LIQUID EJECTING HEAD, LIQUID EJECTING HEAD UNIT, LIQUID EJECTING APPARATUS, AND METHOD OF MANUFACTURING LIQUID EJECTING HEAD UNIT

(71) Applicant: SEIKO EPSON CORPORATION, Tokyo (JP)

(72) Inventors: Hiroshige Owaki, Okaya (JP); Hiroyuki Ishii, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 3 days.

(21) Appl. No.: 14/213,902

(22) Filed: Mar. 14, 2014

(65) Prior Publication Data

US 2014/0292923 A1 Oct. 2, 2014

(30) Foreign Application Priority Data

Mar. 26, 2013 (JP) ..... 2013-063724

(51) Int. Cl.

| | |
|---|---|
| ***B41J 2/145*** | (2006.01) |
| ***B41J 2/21*** | (2006.01) |
| ***B41J 25/34*** | (2006.01) |
| ***B41J 2/16*** | (2006.01) |

(52) U.S. Cl.

CPC *B41J 2/145* (2013.01); *B41J 2/162* (2013.01); *B41J 2/2135* (2013.01); *B41J 25/34* (2013.01); *Y10T 29/49401* (2015.01)

(58) Field of Classification Search

CPC ..... B41J 2/162; B41J 2/16; B41J 2/145; B41J 2/2135; B41J 25/34

USPC ..... 347/20, 37

See application file for complete search history.

(56) References Cited

U.S. PATENT DOCUMENTS

| | | | | |
|---|---|---|---|---|
| 6,484,400 | B1 * | 11/2002 | Motegi | B41J 2/1433 156/252 |
| 7,040,741 | B2 * | 5/2006 | Nakamura et al. | 347/71 |
| 2010/0182377 | A1 | 7/2010 | Hagiwara et al. | |

(Continued)

FOREIGN PATENT DOCUMENTS

| | | |
|---|---|---|
| JP | 2008-194972 | 8/2008 |
| JP | 2008/279694 | 11/2008 |

(Continued)

OTHER PUBLICATIONS

European Search Report for Application No. 14161262.2 dated Jun. 26, 2014.

*Primary Examiner* — Jason Uhlenhake

(74) *Attorney, Agent, or Firm* — Workman Nydegger

(57) ABSTRACT

A liquid ejecting head includes a liquid ejecting head main body that has a nozzle group that is formed by arranging a plurality of nozzles, which eject a liquid, in parallel, and that ejects a liquid from each nozzle, and a fixation member to which the liquid ejecting head main body is fixed. The fixation member has a fixation part to which the liquid ejecting head main body is fixed and a reference surface that is formed on a side opposite fixation part, and which includes a reference part serving as reference for a positioning the liquid ejecting head main body with respect to an installation target, and a position adjusting part adjusting the relative position between the reference surface and the nozzle group is provided between the liquid ejecting head main body and the fixation part.

9 Claims, 9 Drawing Sheets

(56) References Cited

U.S. PATENT DOCUMENTS

| | | | | |
|---|---|---|---|---|
| 2010/0289854 | A1* | 11/2010 | Hagiwara et al. | 347/44 |
| 2012/0306960 | A1 | 12/2012 | Niihara et al. | |

FOREIGN PATENT DOCUMENTS

| | | |
|---|---|---|
| JP | 2010/042625 | 2/2010 |
| JP | 2010/274393 | 12/2010 |

* cited by examiner

LIQUID EJECTING HEAD, LIQUID EJECTING HEAD UNIT, LIQUID EJECTING APPARATUS, AND METHOD OF MANUFACTURING LIQUID EJECTING HEAD UNIT

BACKGROUND

1. Technical Field

The present invention relates to a liquid ejecting head that ejects a liquid from a nozzle, a liquid ejecting head unit that is provided with a plurality of the liquid ejecting heads, a liquid ejecting apparatus that is provided with the liquid ejecting head unit, and a method for manufacturing a liquid ejecting head unit.

2. Related Art

Liquid ejecting apparatuses are apparatuses that are provided with a liquid ejecting head that is capable of ejecting a liquid as liquid droplets from a nozzle, and that ejects various liquids from the liquid ejecting head. As a representative example of this kind of liquid ejecting apparatus, it is possible to include an image recording apparatus such as an ink jet type recording apparatus (printer) that is provided with an ink jet type recording head (hereinafter, referred to as a recording head) and performs recording by ejecting liquid ink (in the form of ink droplets) from a nozzle of the recording head. Further, in addition to the above, liquid ejecting apparatuses are used in the ejecting of various types of liquid such as color materials that are used in color filters for liquid crystal displays and the like, organic materials that are used in organic EL (Electro Luminescence) displays, and electrode materials that are used in electrode formation. Further, liquid ink is ejected in recording heads for image recording apparatuses, and solutions of the respective color materials of R (Red), G (Green) and B (Blue) are ejected from color material ejecting heads for display manufacturing apparatuses. In addition, liquid electrode material is ejected from electrode material ejecting heads for electrode formation apparatuses, and solutions of living organic matter are ejected from living organic matter ejecting heads for chip manufacturing apparatuses.

As a printer such as that mentioned above, there is a printer that is equipped with a recording head unit in which a plurality of recording heads are fixed to a support member (for example, refer to JP-A-2008-194972). Each recording head introduces ink from an ink supply source (such as an ink cartridge) into a pressure chamber (pressure generation chamber). Each recording head generates a pressure variation in the ink inside the pressure chamber by operating pressure generation means, such as a piezoelectric element or a heater element. Each recording head is further configured to eject the ink inside the pressure chamber (in the form of ink droplets) from a nozzle (which is open on a nozzle surface) using the pressure variation. In addition, in a state in which the nozzle surface of each recording head is exposed from an opening of the support member, each recording head is fixed to the edge of the opening by a screw or the like.

In the above-described configuration, it is necessary to fix each recording head to the support member in a state in which the relative position thereof is stipulated with high accuracy. This is to land the liquid droplets (that are ejected from each recording head) with higher positional accuracy on a landing target such as a recording medium. In particular, there are cases where the ink ejecting characteristics (for example, the skew of ink droplets during flight or the like) of each recording head differ respectively. Therefore, in that case, it is necessary to perform position adjustment considering the ejecting characteristics for each recording head. However, the work for respectively adjusting the installation position of each recording head when fixing each recording head to the support member is troublesome. In addition, for example, in a case where a single recording head is exchanged during repair or the like, it is necessary to perform readjustment of the installation position when fixing the recording head to the support member again. This leads to a deterioration in the rate of operation.

SUMMARY

An advantage of some aspects of the invention is that it provides a liquid ejecting head that is capable of improving the installation workability when installing liquid ejecting heads in support members, a liquid ejecting head unit, a liquid ejecting apparatus and a method of manufacturing a liquid ejecting head unit.

According to an aspect of the invention, there is provided a liquid ejecting head main body that has a nozzle group that is formed by arranging a plurality of nozzles, which eject a liquid, in parallel, to eject a liquid from each nozzle; and a fixation member to which the liquid ejecting head main body is fixed, in which the fixation member has a fixation part to which the liquid ejecting head main body is fixed, and a reference surface that is formed on a side opposite the fixation part, and includes a reference part serving as a reference for positioning the liquid ejecting head main body with respect to an installation target, and a position adjusting part for adjusting the relative position between the reference surface and the nozzle group is provided between the liquid ejecting head main body and the fixation part.

According to this configuration, it is possible to prepare a liquid ejecting head in which the relative position between the reference surface and the liquid ejecting head main body is adjusted in advance. Therefore, for example, by merely defining the relative position of the reference surface for the support member when fixing the liquid ejecting head to the support member, that is, by merely bring the reference part into contact with the support member, it is possible to accurately define the relative position of the liquid ejecting head main body. As a result, the work to correct positional deviation of a liquid ejecting head main body that is fixed to the support member is not necessary, and it is possible to improve the workability when installing the liquid ejecting head in the support member.

In the above-described configuration, it is desirable that the relative position of the nozzle group for the reference surface be adjusted based on a pattern that is formed on a landing target by ejecting a liquid from each nozzle of the liquid ejecting head main body.

According to this configuration, it is possible to perform position adjustment of the liquid ejecting head main body in consideration of the liquid-ejecting characteristics (for example, the skew of ink droplets during flight or the like) of the liquid ejecting head main body. Therefore, it is possible to more accurately define the relative position of the liquid ejecting head main body for the support member.

In addition, in the above-described configuration, it is desirable that the nozzle group be configured by a nozzle string in which the nozzles are lined up in a straight line, and the relative position of the nozzle string is adjusted so that a linear pattern formed on the landing target by ejecting a liquid from the nozzle string in a direction along the reference surface, and a reference line of which the relative position with respect to the reference surface is defined, are parallel.

According to this configuration, it becomes easier to adjust the relative position between the reference surface and the nozzle group. Additionally, the term "nozzle string" mentioned here is not limited to a nozzle string in which the nozzles are lined up in a straight line, and for example, includes a nozzle string in which the nozzles are arranged diagonally with respect to the reference surface, and a so-called two-dimensional arrangement type nozzle string in which the nozzles are arranged in a direction parallel to the reference surface and in which nozzles are alternately shifted in a direction perpendicular to the arrangement direction. In addition, the term "parallel" mentioned here includes a case of being slightly shifted from a parallel state within an allowable error margin of the specifications of the product.

Furthermore, according to another aspect of the invention, there is provided a liquid ejecting head unit including the liquid ejecting head of the invention, and a support member in which the liquid ejecting head is installed using the fixation member, in which the support member has an installation surface that defines an installation position of the fixation member in the support member.

According to this configuration, by merely defining the relative position between the installation surface and the reference surface when fixing the liquid ejecting head to the support member, it is possible to accurately define the relative position of the liquid ejecting head main body for the support member. As a result, the work to correct a positional deviation of a liquid ejecting head main body that is fixed to the support member is not necessary, and it is possible to improve the workability when installing the liquid ejecting head in the support member.

In addition, in the above-described configuration, it is desirable that the support member and the fixation member be positioned by bring the installation surface into contact with the reference part.

According to this configuration, it is possible to easily define the relative position of the liquid ejecting head main body for the support member. As a result, it is possible to improve the workability when installing the liquid ejecting head in the support member.

Further, according to still another aspect of the invention, there is provided a liquid ejecting apparatus including the liquid ejecting head unit.

In addition, according to still another aspect of the invention, there is provided a method of manufacturing a liquid ejecting head unit including a liquid ejecting head that is provided with a liquid ejecting head main body that has a nozzle group that is formed by arranging a plurality of nozzles, which eject a liquid, in parallel, to eject a liquid from each nozzle, and a fixation member that has a fixation part to which the liquid ejecting head main body is fixed, and a reference surface that is formed on a side opposite to the fixation part, and which includes a reference part serving as a reference for positioning the liquid ejecting head main body with respect to an installation target; and a support member that has an installation surface in which the liquid ejecting head is installed using the fixation member, the method including adjusting the relative position between the nozzle group of the liquid ejecting head main body and the reference surface of the fixation member; fixing the fixation member and the liquid ejecting head main body by positioning a position adjusting part between the liquid ejecting head main body and the fixation part in a state in which the nozzle group has been positioned with respect to the reference surface; and fixing the support member and the fixation member to each other in a state of being positioned with respect to the support member by bring the reference part of the fixation member into contact with the installation surface of the support member.

Furthermore, it is desirable that the adjusting of the relative position includes forming a pattern on a landing target by ejecting a liquid from each nozzle of the liquid ejecting head main body; and adjusting the relative position of the nozzle group with respect to the reference surface based on the pattern.

BRIEF DESCRIPTION OF THE DRAWINGS

The invention will be described with reference to the accompanying drawings, wherein like numbers reference like elements.

FIGS. 1A and 1B are schematic diagrams illustrating a configuration of a printer, in which FIG. 1A is a plan view and FIG. 1B is a side view.

FIGS. 3A and 3B are schematic diagrams illustrating a configuration of a head unit, in which FIG. 3A is a front view and FIG. 3B is a bottom view.

FIGS. 4A and 4B are schematic diagrams illustrating a configuration of a base plate, in which FIG. 4A is a front view and FIG. 4B is a bottom view.

FIGS. 5A and 5B are perspective views schematically illustrating a configuration of a unit head, in which FIG. 5A is a perspective view of a state in which a fixation member is installed, and FIG. 5B is a perspective view of a state in which a fixation member is removed.

FIGS. 7A and 7B are schematic diagrams illustrating a configuration of a fixation member, in which FIG. 7A is a front view and FIG. 7B is a bottom view.

DESCRIPTION OF EXEMPLARY EMBODIMENTS

Hereinafter, embodiments of the present invention will be described with reference to the accompanying drawings. Additionally, in the embodiments that are described below, various limitations are given as preferred specific examples of the present invention. However, the scope of the invention is not limited to these aspects unless a feature that limits the present invention is particularly stated in the following description. In addition, in the following description, an ink jet type printer (hereinafter, referred to as a printer 1) is used as an example of a liquid ejecting apparatus of the invention. In the printer 1, there are mounted a plurality of ink jet recording heads (hereinafter, referred to as unit heads 7), which are a type of liquid ejecting head.

Figure 1A:
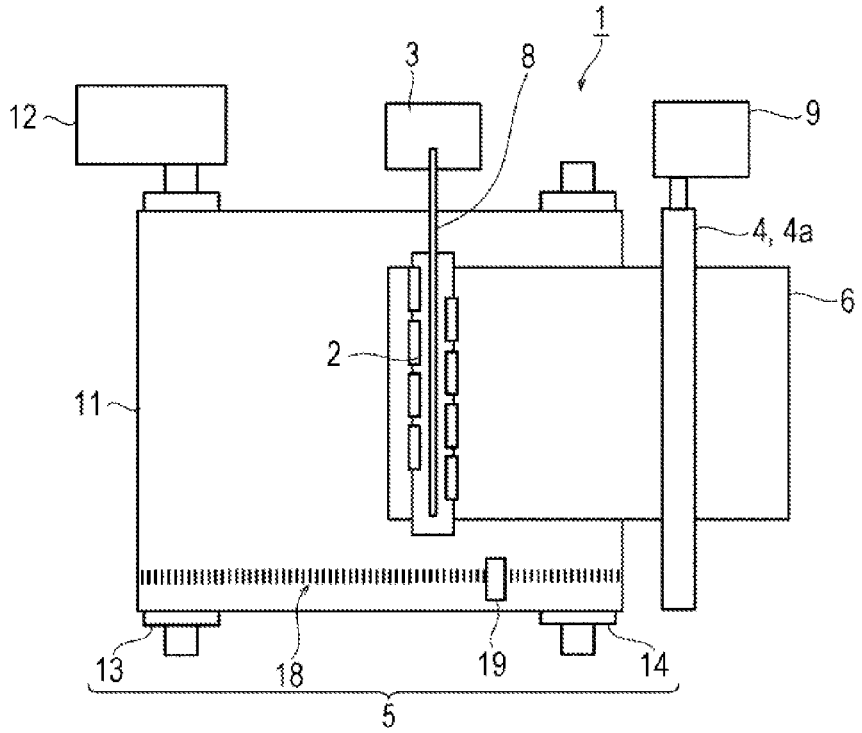
Figure 1B:
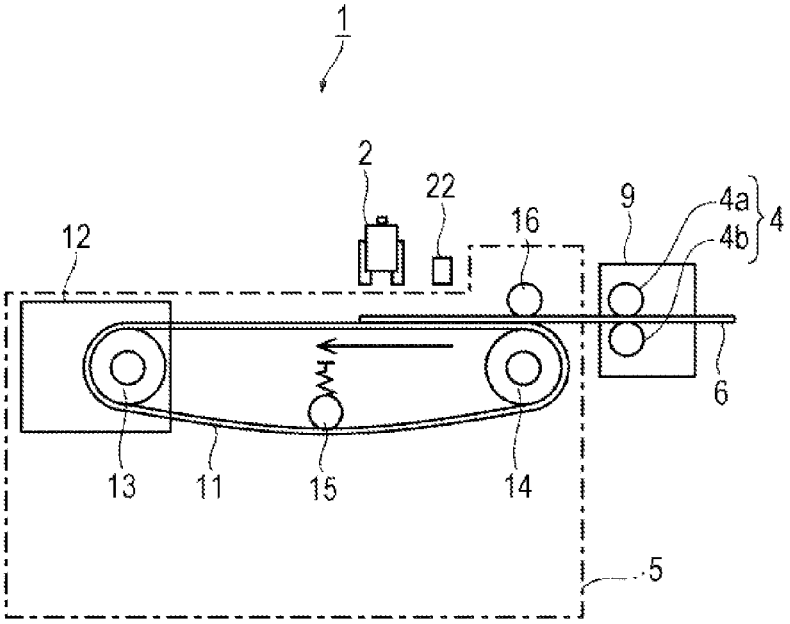

FIG. 1A is a plan view schematically illustrating a configuration of a printer 1. FIG. 1B is a side view of the printer 1. The printer 1 is provided with a head unit 2 (corresponding to the liquid ejecting head unit in the invention), an ink tank 3, a paper supply roller 4 and a transport mechanism 5. The head unit 2 is a device in which a plurality of unit heads 7 are arrayed, which unit heads 7 perform recording of images or the like by ejecting a liquid ink, are arranged. The head unit 2 extends in an oblong manner along a paper width direction (a direction perpendicular to a transport direction of recording paper 6) of recording paper 6 (a sort of recording medium or landing object). The ink tank 3 is a sort of storage member (a liquid supply source) in which ink is stored for supply to the head unit 2. The ink that is inside the ink tank 3 is supplied to the head unit 2 through an ink supply tube 8. Additionally, it is possible to employ a configuration in which the liquid supply source is equipped with above the head unit 2. In addition, a specific configuration of the head unit 2 will be described later.

The paper supply roller 4 is arranged upstream of the transport mechanism 5, and is configured by an upper and lower pair of rollers 4*a* and 4*b* that are synchronously rotatable in directions opposite to each other with the recording paper 6 interposed therebetween and supplied from a paper feeding section (not illustrated). The paper feeding roller 4 is driven by power from a paper feeding motor 9, and supplies the recording paper 6 to a transport mechanism 5 side after correcting a tilt of the recording paper 6 with respect to the transport direction and a positional deviation thereof in a direction (the paper surface direction of the recording paper 6) perpendicular to the transport direction by causing skew correction rollers (not illustrated) to collaborately operate.

The transport mechanism 5 is provided with a transport belt 11, a transport motor 12, a drive roller 13, a driven roller 14, a tension roller 15 and a pressure contact roller 16. The transport motor 12 is a drive source of the transport mechanism 5, and conveys power to the drive roller 13. The transport belt 11 is an endless belt, and is stretched tightly between the drive roller 13 and the driven roller 14. The tension roller 15 is in contact with an inner peripheral surface of the transport belt 11 between the drive roller 13 and the driven roller 14, and applies a tensile force to the transport belt 11 using a biasing force of a biasing member such as a spring. The pressure contact roller 16 is disposed directly above the driven roller 14 with the transport belt 11 interposed therebetween, and presses the recording paper 6 on the transport belt 11.

A linear scale 18 is disposed over the entire circumference of the belt on an outer peripheral surface of the transport belt 11. The linear scale 18 is configured by arranging a plurality of slit-shaped patterns for detection at regular intervals (for example, 360 per linear inch) in a transport direction of the transport belt 11. The patterns for detection of the linear scale 18 are detected optically by a detection head 19, and detected signals are output as encoder signals to a control unit (not illustrated) of the printer 1. Therefore, based on the encoder signal, the control unit can ascertain the amount that the recording paper 6 has been transported using the transport mechanism 5 (the transport belt 11). In addition, the encoder signal defines a generation timing of the drive signal for driving a piezoelectric element 65 (to be described later) of the unit heads 7.

Figure 2:
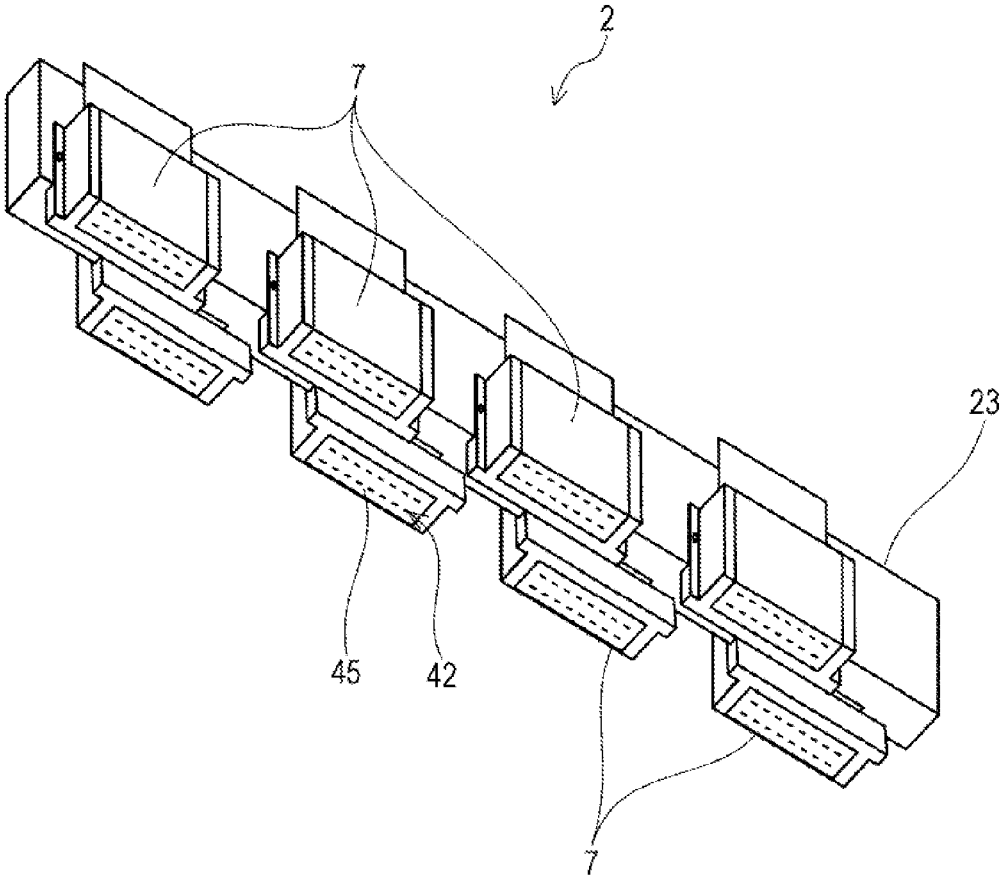
FIG. 2 is a perspective view of a head unit viewed from a nozzle surface side.
Figure 3A:
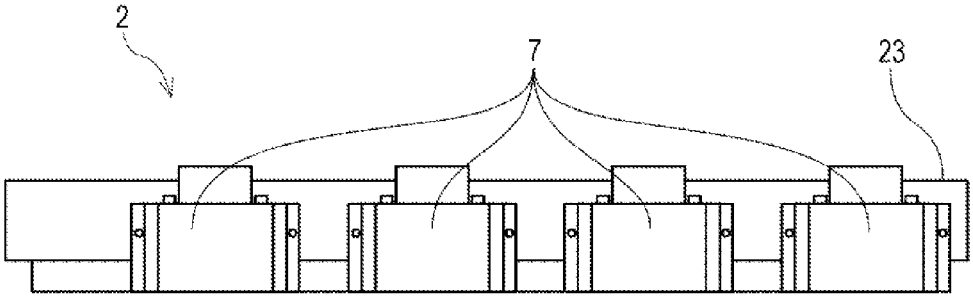
Figure 3B:
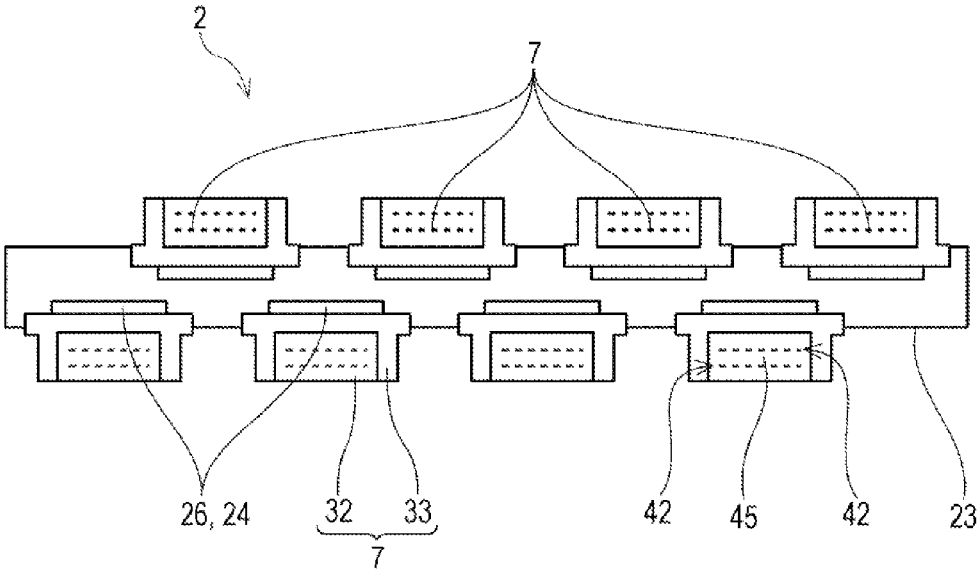
Figure 4A:
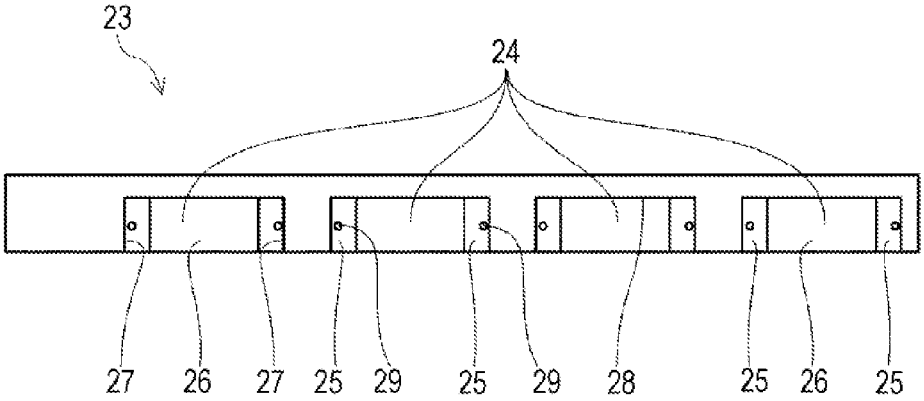
Figure 4B:
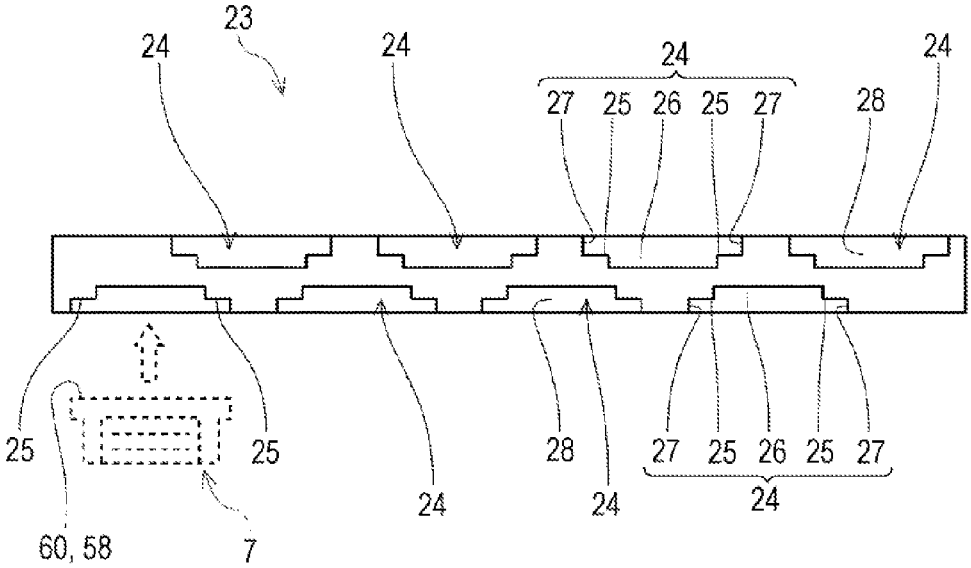

Next, the head unit 2 will be described with reference to the drawings. FIG. 2 is a perspective view of the head unit 2 viewed from the side of a nozzle surface 45 (a side of a nozzle plate 39, refer to FIG. 6). In addition, FIGS. 3A and 3B are schematic diagrams illustrating a configuration of the head unit 2. FIG. 3A is a front view of the head unit 2 and FIG. 3B is a bottom view of the head unit 2. Furthermore, FIGS. 4A and 4B are schematic diagrams illustrating a configuration of a base plate 23. FIG. 4A is a front view of the base plate 23 and FIG. 4B is a bottom view of the base plate 23.

The head unit 2 in the present embodiment is configured by installing a plurality of unit heads 7 (corresponding to liquid ejecting heads in the invention) in a base plate 23 (corresponding to a support member in the invention). In the present embodiment, four unit heads 7 respectively sandwich the base plate 23 and are installed in each side thereof. That is, a total of eight unit heads 7 are installed in the base plate 23. The unit heads 7 are lined up at equivalent or regular intervals along a longitudinal direction of the base plate 23. Further, a row of the unit heads 7 that is lined up on a first side of the base plate 23 and a row of the unit heads 7 that is lined up on a second side thereof are lined up so as to be shifted by a distance of half the lining-up pitch of the unit heads 7.

The base plate 23 is a plate material that is elongated in a parallel arrangement (lining-up) direction (or a nozzle string direction) of the unit heads 7, and for example, is made of a metal such as stainless steel. As illustrated in FIGS. 4A and 4B, a storage section 24 (in which a part of the unit head 7 is stored) is provided in a position that corresponds to the unit head 7 on the surface of each side of the base plate 23. That is, the storage section 24 is provided at each installation position of the unit head 7 of the base plate 23, and thus a total of eight storage sections 24 are collectively formed on both sides thereof. The storage section 24 includes flat installation surfaces 25 that are depressed from one side surface of the base plate 23 toward the other side surface. The storage section 24 allows the unit head 7 (a reference part 60 of a fixation member 33) to be installed therein. The storage section 24 further includes a vacancy 26 that is further depressed from the installation surfaces 25 toward the other side surface. The storage section 24 also includes receiving surfaces 27 that are perpendicular to the installation surfaces 25. In addition, the storage section 24 is provided with a ceiling 28 that is formed from a lower end of the base plate 23 to the middle in the height direction of the base plate (the height direction being a direction perpendicular to the nozzle surface 45). An upper end of the storage section 24 is in contact with an upper end of the unit head 7. In the present embodiment, a depth (a dimension in the thickness direction of the base plate 23) of the storage section 24 is formed to be smaller than a thickness (a dimension in the same direction) of the unit head 7, and a height of the storage section 24 is formed to be smaller than a height of the unit head 7. For this reason, as illustrated in FIGS. 3A and 3B, in a state in which the unit head 7 is installed in the storage section 24, the front part (a side opposite the base plate 23) of the unit head 7 protrudes forward from the base plate 23, and the lower end (the nozzle surface 45) of the unit head 7 is exposed from the lower end of the base plate 23. Further, a dimension of the storage section may be formed to match a dimension of the unit head so that the unit head does not protrude from the storage section.

As illustrated in FIG. 4B, the installation surfaces 25, which define an installation position of the fixation member 33 (to be described later) for the base plate 23, are surfaces perpendicular to the nozzle surface 45. The installation surfaces 25 are provided on both sides with the vacancy 26 interposed therebetween in the storage section 24 in the parallel arrangement direction of the unit heads 7. As illustrated in FIG. 4A, screw holes 29 are respectively opened in the installation surfaces 25 on both sides, and thus the unit head 7 is installed using screws. Here, the installation surfaces 25 are in contact with the reference part 60 of the unit head 7 (fixation member 33) and serve as a positioning reference of the unit head 7, that is, required to have high flatness, and thus preferably have a small area. For this reason, the installation surfaces 25 of the present embodiment are made to have as small an area as possible in the storage section 24, thereby increasing positioning accuracy. Specifically, in a front view, an area of the installation surfaces 25 is smaller than an area of the vacancy 26. In addition, the vacancy 26 is set to have a depth which prevents the unit head 7 from being in contact with an inner wall surface forming the vacancy 26 when the unit head 7 is installed on the installation surfaces 25. Accordingly, the installation surfaces 25 function as surfaces defining a position of the unit head 7. In addition, in the present embodiment, the part of the unit head 7 opposing the vacancy 26 is formed to be coplanar with a reference surface 58. Thus, it is not necessary to considerably depress the vacancy 26 further toward the other surface side as compared to the installation surfaces 25. For this reason, the vacancy 26 of the present embodiment is formed to be slightly depressed further toward the other surface side than the installation surfaces 25. Accordingly, a sufficient thickness of the base plate 23 can be obtained, thus enabling increased strength of the base plate 23.

The receiving surfaces 27 form inner walls of both ends of the storage section 24 in the parallel arrangement direction of the unit heads 7, and are perpendicular to the installation surfaces 25 and the nozzle surface 45. A gap (that is, a width of the storage section 24 in the parallel arrangement direction of the unit heads 7) between one receiving surface 27 and the other receiving surface 27 is aligned with the width of the unit head 7 stored in the storage section 24 and defines a position of the unit head 7 in the parallel arrangement direction of the unit heads 7. In addition, the ceiling 28 is a surface parallel to the nozzle surface 45, and defines a position of the unit head 7 in the height direction.

Figure 5A:
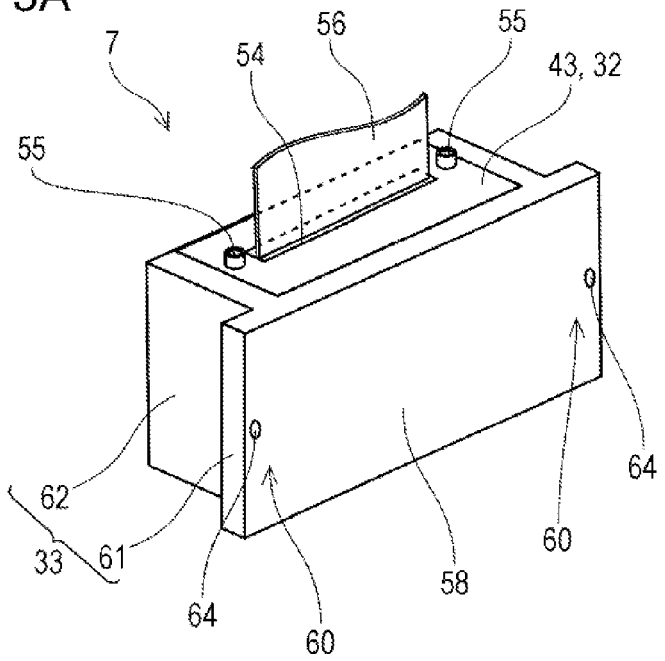
Figure 5B:
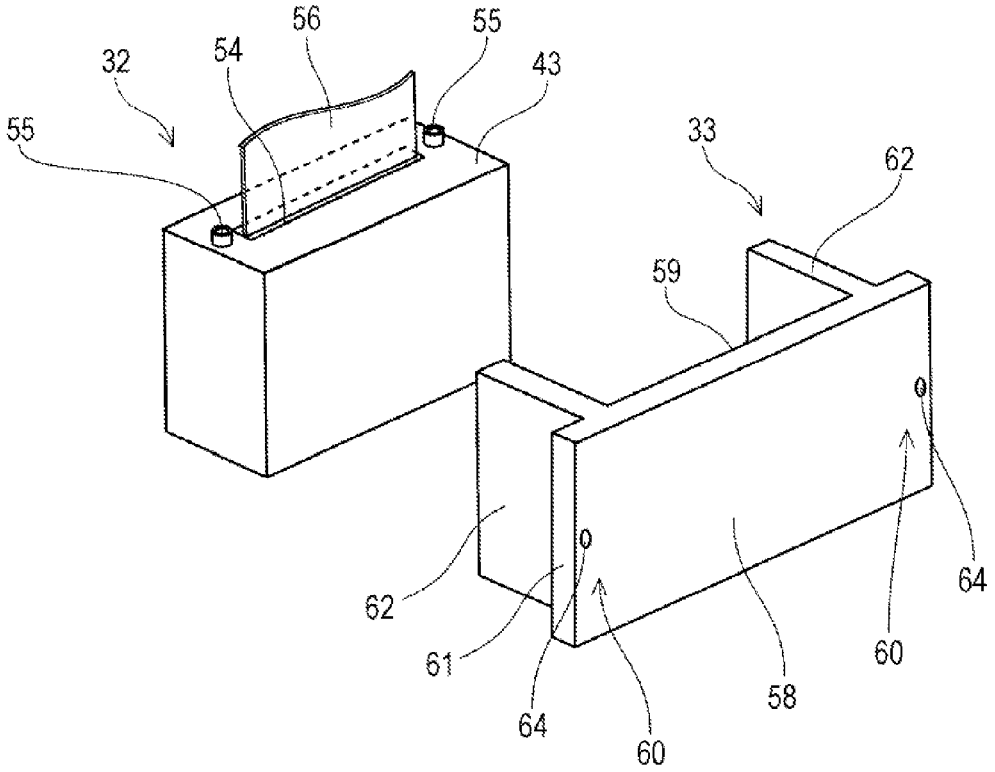
Figure 6:
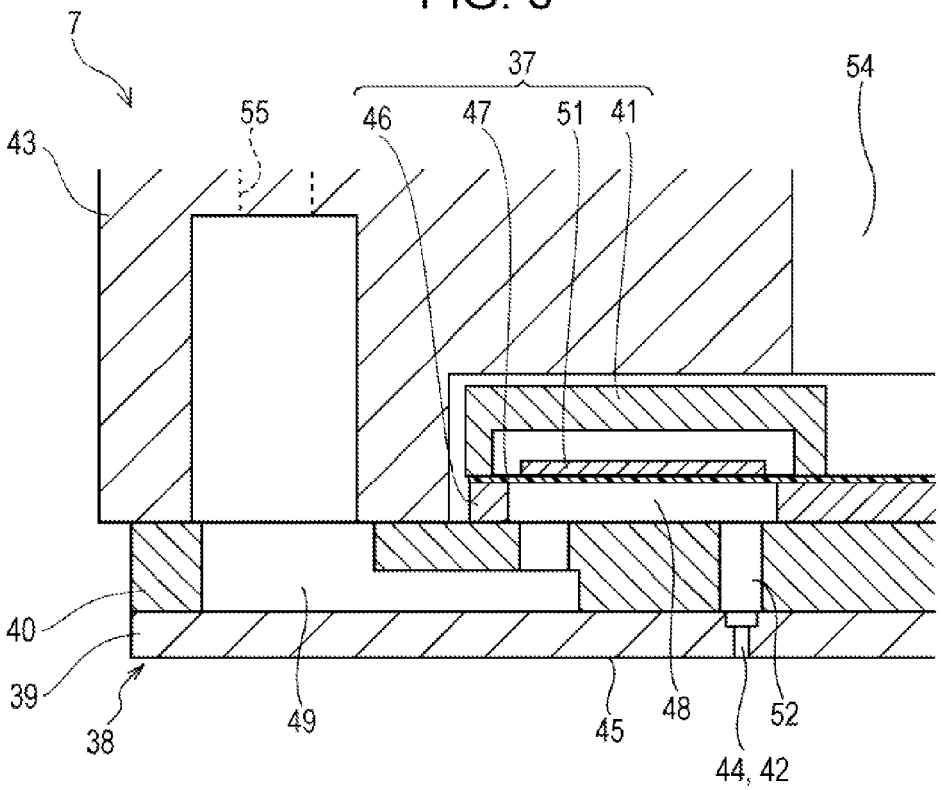
FIG. 6 is a cross-sectional view of the main parts of a unit head main body.
Figure 7A:
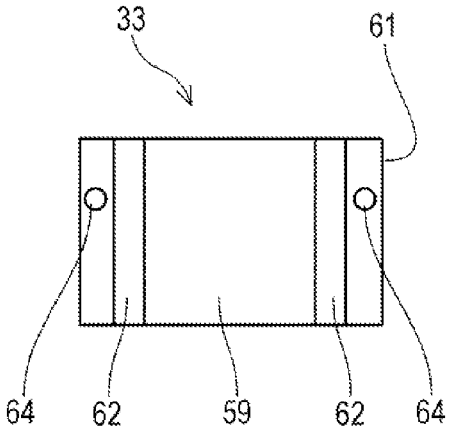
Figure 7B:
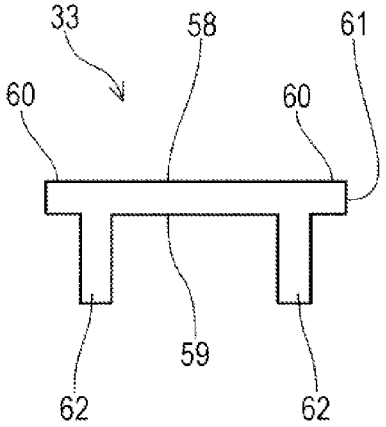

FIGS. 5A and 5B are schematic diagrams illustrating a configuration of the unit head 7. FIG. 5A is a perspective view illustrating a state in which the fixation member 33 is installed. FIG. 5B is a perspective view illustrating a state in which the fixation member 33 is not installed. In addition, FIG. 6 is a cross-sectional view of a main part of a unit head main body 32. Further, FIGS. 7A and 7B are schematic diagrams illustrating a configuration of the fixation member 33, in which FIG. 7A is a front view of the fixation member 33, and FIG. 7B is a bottom view of the fixation member 33. In FIG. 6, a configuration of a main part corresponding to the other nozzle string 42 is horizontally symmetrical to the illustrated configuration, and thus is not illustrated.

The unit head 7 includes the unit head main body 32 (corresponding to a liquid ejecting head main body in the invention) which ejects ink droplets from nozzles 44. The unit head 7 further includes the fixation member 33 that is installed on one side surface (a surface on a side opposing the installation surfaces 25 when installed in the base plate 23) of the unit head main body 32. In addition, the unit head main body 32 and the fixation member 33 are fixed to each other by using an adhesive 34 (corresponding to a position adjusting part in the invention) in a state in which a relative position between the unit head main body and the fixation member 33 is adjusted. As illustrated in FIG. 6, the unit head main body 32 of the present embodiment includes a pressure generation unit 37 and a channel unit 38, and is configured to be installed in a case 43 (a sort of enclosure member of the unit head main body 32) in a state in which these members are stacked.

The case 43 forms the major part of an upper surface and a side surface of the unit head main body 32, and is a box-shaped member, made of a resin. The side surface side of the case 43 is fixed to a fixation surface 59 of the fixation member 33. As illustrated in FIGS. 5A and 5B, a through-hole 54 (which has a rectangular opening elongated in the nozzle string direction) is formed in a central in a plan view of the case 43 in a state in which the opening penetrates through the case 43 in the height direction. In addition, one end of a flexible cable 56 is accommodated in the through-hole 54. Further, ink introduction paths 55 are formed in the case 43. Upper ends of the ink introduction paths 55 protrude upward from the upper surface of the case 43 as illustrated in FIGS. 5A and 5B. In the present embodiment, two ink introduction paths 55 protrude so as to correspond to two nozzle strings 42, and are connected to the ink supply tube 8. Furthermore, channels may be provided in the base plate 23, and the ink introduction paths 55 may be connected to the channels. Thus, in the present embodiment, the ink is introduced into the ink introduction paths 55 from the ink supply tube 8 through the channels. Moreover, lower ends of the ink introduction paths 55 are connected to a liquid supply channel 49 of the channel unit 38.

As illustrated in FIG. 6, the channel unit 38 includes the nozzle plate 39 (a sort of nozzle formation member) in which a plurality of nozzles 44 are opened in a straight line shape (a line shape). The channel unit 38 also includes a communication substrate 40 in which the liquid supply channel 49 is defined. The plurality of lined-up nozzles 44 are provided at equal intervals from the nozzle 44 on one end side to the nozzle 44 on the other end side with pitches corresponding to a dot formation density. In the present embodiment, 360 nozzles 44 are lined up with pitches corresponding to 360 dpi, thereby forming the nozzle string 42 (a sort of nozzle group). In addition, in the present embodiment, the two nozzle strings 42 are formed in the nozzle plate 39. Further, a lower surface of the nozzle plate 39 corresponds to the nozzle surface 45.

Further, the pressure generation unit 37 is formed as a unit in which is stacked a pressure chamber formation substrate 46 (a sort of pressure chamber formation member) in which a pressure chamber 48 is formed, an elastic membrane 47, a piezoelectric element 51, and a protective substrate 41. The ink is introduced into the pressure chamber 48 through the liquid supply channel 49. Further, a driving signal from the control unit is supplied to the piezoelectric element 51 via the flexible cable 56 so as to drive the piezoelectric element 51, thereby causing pressure variation of the pressure chamber 48. This pressure variation is used, thereby ejecting ink droplets from the nozzles 44 via a nozzle communication path 52 of the communication substrate 40.

The unit head main body 32 with this configuration is fixed to the fixation member 33 and is installed in the base plate 23 via the fixation member 33. As illustrated in FIGS. 7A and 7B, the fixation member 33 includes the fixation surface 59 (corresponding to a fixation part in the invention) to which the unit head main body 32 is fixed. The fixation member 33 also includes the reference surface 58 that is formed on a side opposite the fixation surface 59 and includes the reference part 60 serving as a positioning reference for an installation target (base plate 23) of the unit head main body 32.

The fixation member 33 of the present embodiment is made of a metal (such as, for example, stainless steel) that has higher rigidity than the case 43. The fixation member includes a plate-shaped part 61 provided with the fixation surface 59 and the reference surface 58 on its front and rear surfaces, and partition walls 62 which protrude from a surface (fixation surface 59) on an opposite side to the reference surface 58 of the plate-shaped part 61. In addition, a dimension (height) of the fixation member 33 in a direction perpendicular to the nozzle surface 45 is aligned so as to be substantially the same as a dimension (height) of the case 43 in the same direction. Further, the unit head main body 32 is fixed to the fixation surface 59 of the fixation member 33 in a state in which the upper surface thereof is aligned with the upper surface of the fixation member 33 and the lower surface (nozzle surface 45) is aligned with the lower surface of the fixation member 33.

The plate-shaped part 61 aligns a dimension (width) of the unit head 7 in the parallel arrangement direction (nozzle string direction) with a width of the storage section 24. The plate-shaped part 61 is fitted between the two receiving surfaces 27 of the storage section 24 in a state in which the fixation member 33 is installed in the storage section 24 of the base plate 23, thereby defining a position of the fixation member 33 (unit head 7) in the same direction. In addition, the upper surface of the plate-shaped part 61 is in contact with the ceiling 28 of the storage section 24 in a state in which the fixation member 33 is installed in the storage section 24 of the base plate 23, thereby defining a position of the fixation member 33 (unit head 7) in the height direction. Further, in the present embodiment, a surface (a surface on an opposite side to the fixation surface 59) on a side opposing the storage section 24 is the flat reference surface 58 serving as a reference of a relative position of the nozzle string 42. Furthermore, in the present embodiment, portions (that are both ends of the reference surface 58 and are in contact with the installation surface 25 of the base plate 23) are set as the reference part 60. Thus, the reference surface 58 becomes an existing flat surface. The reference part 60 is in contact with the installation surface 25 in a state in which the fixation member 33 is installed in the storage section 24 of the base plate 23, thereby defining a position of the fixation member 33 (unit head 7) in a thickness direction (a direction perpendicular to the nozzle string 42 in a surface parallel to the nozzle surface 45) of the base plate 23. Therefore, a plurality of reference parts may be formed in a protruding manner, and a virtual plane including tops thereof may be used as a reference face. The details thereof will be described later.

The partition walls 62, which protrude from the fixation surface 59 (opposite the reference surface 58) are provided on both sides in the width direction further inward than the ends of the plate-shaped part 61 in the width direction (nozzle string direction). A gap between the mutually opposing partition wall 62 and the partition wall 62 is slightly larger than a dimension (width) of the unit head main body 32 in the nozzle string direction. In addition, a dimension of the partition wall 62 in the thickness direction of the plate-shaped part 61 (base plate 23) is substantially the same as a dimension (thickness) of the unit head main body 32 in the same direction. Further, a flat surface on an opposite side to the reference surface 58 of the plate-shaped part 61 interposed between the partition wall 62 and the partition wall 62 corresponds to the fixation surface 59. The unit head main body 32 is installed on the fixation surface 59 via the adhesive 34 (refer to FIG. 9A) in a state of defining a relative position with the fixation member 33 (reference surface 58). Furthermore, through-holes 64 corresponding to the screw holes 29 of the base plate 23 are opened in both ends located further outward than the partition walls 62 of the plate-shaped part 61. An inner diameter of the through-hole 64 is set to be slightly larger than an inner diameter of the screw hole 29 of the base plate 23 so as to finely adjust a relative position between the base plate 23 and the fixation member 33. Further, screws are inserted into the screw holes 29 through the through-holes 64, and thus the fixation member 33 can be fixed to the base plate 23.

Here, a relative position between the fixation member 33 (reference surface 58) and the unit head main body (nozzle string 42) is adjusted on the basis of an alignment pattern (a sort of pattern) that is formed on a landing target by ejecting ink from each nozzle 44 of the unit head main body 32. More specifically, a linear alignment pattern is formed on a landing target by ejecting ink from the nozzle string 42 in a direction along the reference surface 58. A relative position between the fixation member 33 and the unit head main body 32 is adjusted with high accuracy so that the alignment pattern is parallel to the reference surface 58. In addition, a method of adjusting a relative position will be described later. Further, a relative position between the fixation member 33 (reference surface 58) and the unit head main body 32 (nozzle string 42) is adjusted, and the adhesive 34 fills a gap between the fixation surface 59 and the unit head main body 32 in a state of maintaining this adjusted posture. As above, in the present embodiment, the adhesive 34 functions as a position adjusting part for adjusting a relative position between the fixation member 33 (reference surface 58) and the unit head main body 32 (nozzle string 42). In other words, the adhesive 34 allows a gap between the fixation surface 59 and the unit head main body 32 to be adjusted, thereby maintaining a relative position between the fixation member 33 (reference surface 58) and the unit head main body 32 (nozzle string 42). As the adhesive 34, for example, a UV adhesive, an instantaneous adhesive, or the like is used. Such an adhesive of short curing time is used to improve workability.

Next, a manufacturing method of the head unit 2 with the above-described configuration will be described. A manufacturing method of the head unit 2 includes a position adjusting step of adjusting a relative position between the nozzle string 42 of the unit head main body 32 and the reference surface 58 of the fixation member 33. The manufacturing method also includes a unit head creating step of injecting the adhesive 34 between the unit head main body 32 and the fixation surface 59 in a state in which the nozzle string 42 is positioned with respect to the reference surface 58, so as to fix the fixation member 33 to the unit head main body 32. The manufacturing method also includes a unit head installing step of causing the reference part 60 of the fixation member 33 to be in contact with the installation surface 25 of the base plate 23 and fixing the fixation member 33 to the base plate 23 in a state of being positioned with reference to the base plate 23. In addition, the position adjusting step includes an inspection step of forming an alignment pattern on a landing target by ejecting a liquid from each nozzle 44 of the unit head main body 32, and an adjustment step of adjusting a relative position of the nozzle string 42 for the reference surface 58 on the basis of the alignment pattern.

Figure 8A:
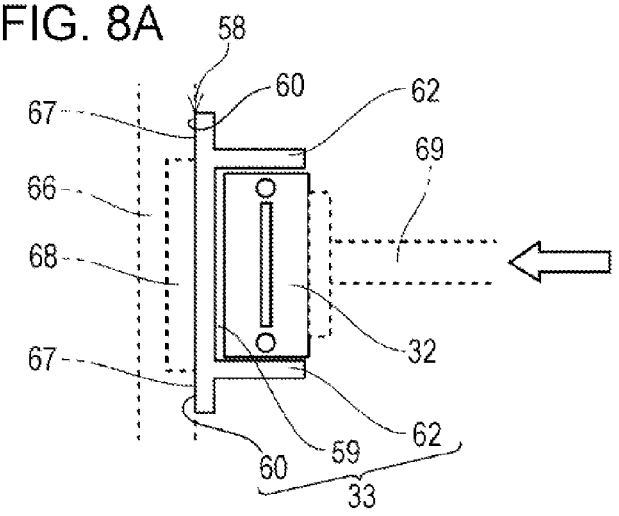
FIGS. 8A to 8E are schematic diagrams illustrating a method of manufacturing a head unit.
Figure 8B:
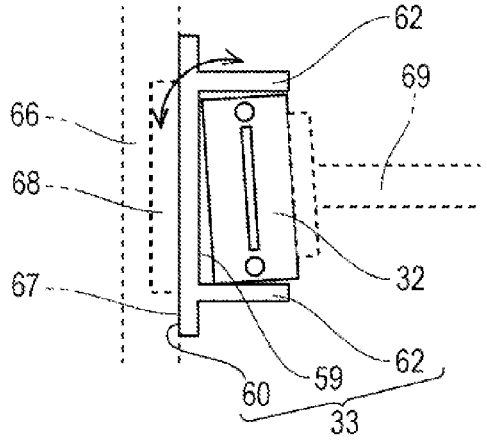
Figure 8D:
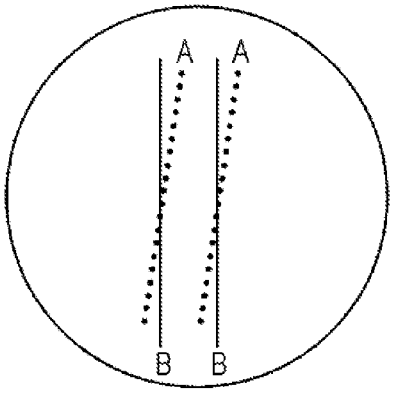
Figure 8C:
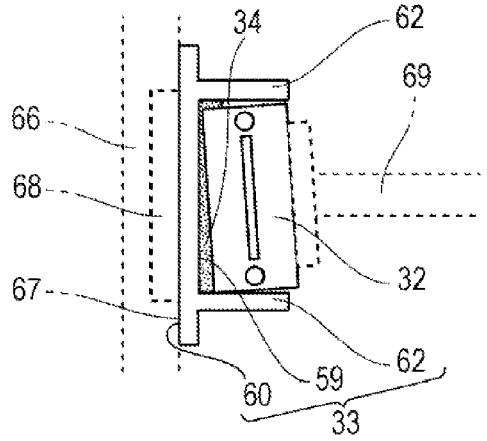
Figure 8E:
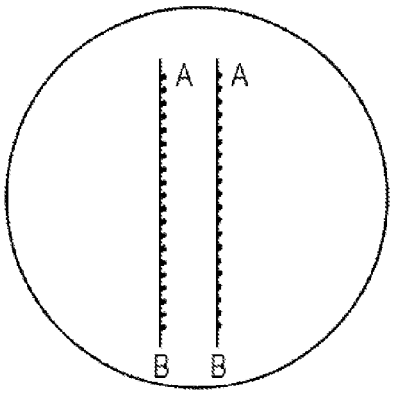
Figure 9A:
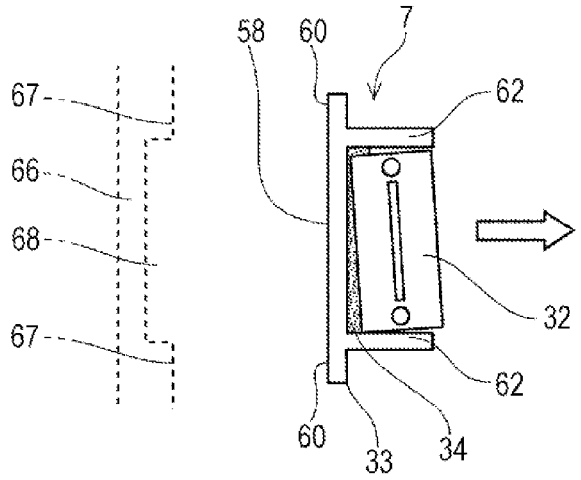
FIGS. 9A and 9B are schematic diagrams illustrating a method of manufacturing a head unit.
Figure 9B:
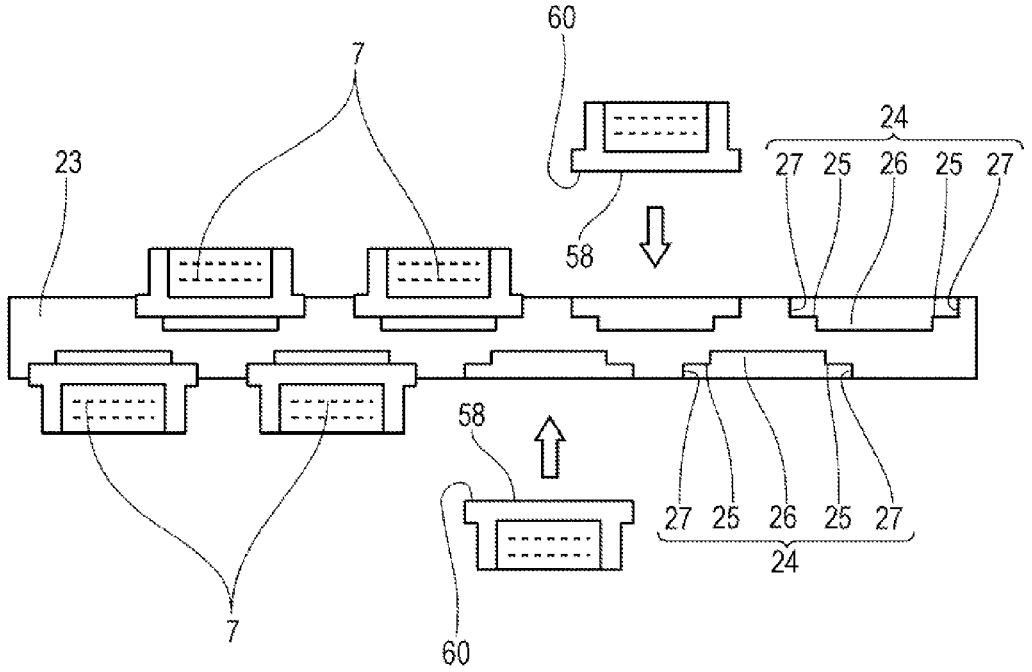

FIGS. 8A to 9B are schematic diagrams illustrating a manufacturing method of the head unit 2. FIGS. 8A to 8C and FIG. 9A are plan views, and FIG. 9B is a bottom view. In addition, in FIGS. 8A to 9B, a jig or the like is indicated by a broken line. Further, FIGS. 8D and 8E are schematic diagrams illustrating examples of an alignment pattern formed on a landing target.

In the position adjusting step, first, the fixation member 33 is installed in a first jig 66. As illustrated in FIG. 8A, the first jig 66 is a jig which holds the fixation member 33, and has temporary installation surfaces 67 where the reference surface 58 of the fixation member 33 is installed. The temporary installation surfaces 67 are formed in the same shape as the shape of the installation surface 25 of the base plate 23. The temporary installation surfaces 67 are provided at two locations that are in contact with the reference parts 60 of the fixation member 33 with a jig vacancy 68 interposed therebetween. In addition, the fixation member 33 is fixed to the first jig 66 via screws in a state in which the reference part 60 is in contact with and positioned with respect to the temporary installation surfaces 67. Next, as illustrated in FIG. 8A, the unit head main body 32 becomes close to the fixation surface 59 of the fixation member 33 by using a second jig 69. The second jig 69 is a jig that is fixed to one surface (a surface on an opposite side to the fixation surface 59 side) of the unit head main body 32 and can advance towards and retreat from the first jig 66. A part of the second jig 69 (to which the unit head main body 32 is installed) can be manually or automatically rotated in a surface parallel to the nozzle surface 45. The unit head main body 32 is accommodated between the partition wall 62 and the partition wall 62 of the fixation member 33 by the second jig 69. Thus, the side surface of the unit head main body 32 (case 43) and the fixation surface 59 are maintained in a parallel state. Further, the ink introduction path 55 of the case 43 is connected to the supply tube (not illustrated) which supplies ink. Thus, the ink is supplied to an internal channel of the unit head main body 32.

Subsequently, in this state, the ink is simultaneously ejected downwardly (a direction along the reference surface 58) from all the nozzles 44 forming the nozzle strings 42 of the unit head main body 32, so as to record a linear ruled line in the nozzle string direction on a landing target on the lower side. In the present embodiment, the unit head main body 32 has two nozzle strings 42, and thus two ruled lines are recorded on the landing target. An image of the recorded alignment patterns is captured by a camera (not illustrated), and is displayed on a screen of a monitor (not illustrated), as illustrated in FIG. 8D or 8E. In addition, in FIGS. 8D and 8E, the ruled lines indicated by the broken lines A are the alignment patterns recorded by the unit head main body 32, and the ruled lines indicated by the solid lines B are reference lines. In the present embodiment, the reference lines B are displayed on the monitor in a superimposition manner on the captured image of the alignment patterns A. In addition, the reference lines B are arranged in two lines so as to the two alignment patterns A. Further, the reference lines B are adjusted (that is, a relative position for the reference surface 58 is defined) so as to be parallel to the reference surface 58 (or the temporary installation surface 67 of the first jig 66) of the fixation member 33 installed in the first jig 66. Furthermore, a deviation between the reference lines B and the recorded alignment patterns A is checked (inspected) from the monitor (inspection step).

In this case, for example, in a case where the recorded alignment patterns A are tilted with respect to the reference lines B as illustrated in FIG. 8D, the position of the unit head main body 32 is adjusted so that the alignment patterns A are parallel to the reference lines B by using the second jig 69 as illustrated in FIG. 8B. Accordingly, a relative position between the reference surface 58 and the nozzle strings 42 is indirectly adjusted. For example, a tilt angle of the alignment patterns A relative to the reference lines B is measured with a scale (not illustrated) or the like, and an angle (tilt) of the unit head main body 32 in the surface parallel to the nozzle surface 45 is adjusted on the basis of the tilt angle (adjusting step). In addition, in relation to a tilt of the alignment patterns A relative to the reference lines B, an allowable error margin of the specifications of the product (for example, a distance between the end (a pattern corresponding to the nozzle located at the end of the nozzle string 42) of the alignment pattern A and the reference line B is 0±10 μm) may be prescribed. The adjustment may be performed so that a tilt falls within the target margin. Further, after the position of the unit head main body 32 is adjusted, the alignment patterns A may be recorded again, and a tilt thereof relative to the reference lines B may be checked, so that a position of the unit head main body 32 is adjusted using the second jig 69 until the alignment patterns A become parallel to the reference lines B as illustrated in FIG. 8E. As described above, the alignment patterns A are made parallel to the reference lines B, and thus the reference surface 58 can be made parallel to the alignment patterns A.

Next, in the unit head creating step, as illustrated in FIG. 8C, the adhesive 34 fills a gap between the unit head main body 32 having undergone the position adjustment in the adjusting step and the fixation surface 59 of the fixation member 33. At this time, the second jig 69 holds the position of the unit head main body 32 until the adhesive 34 is cured. In addition, as illustrated in FIG. 9A, the fixation member 33 is detached from the first jig 66 after the adhesive 34 is cured, and thus the unit head 7 is completed in which a relative position between the fixation member 33 (reference surface 58) and the unit head main body (nozzle string 42) is defined. Further, in the unit head 7 created in this way, the adhesive 34 functions as a position adjusting part which adjusts a relative position between the fixation member 33 and the unit head main body 32. In other words, as a result of adjusting a relative position between the fixation member 33 and the unit head main body 32, as illustrated in FIG. 9A, a gap between the fixation surface 59 of the fixation member 33 and the unit head main body 32 may be defined, but the gap is filled with (disposed in) the adhesive 34, and thus it is possible to maintain a relative position between the fixation member 33 and the unit head main body 32. Furthermore, a spacer made of a resin or the like may be separately used as the position adjusting part disposed in this gap, in addition to the adhesive 34.

Next, in the unit head installation step, as illustrated in FIG. 9B, the unit heads 7 manufactured in the above-described steps are sequentially fixed to the storage sections 24 of the base plate 23. At this time, the fixation member 33 (unit head 7) is fitted between the receiving surfaces 27 of both sides of the base plate 23, thereby defining a position of the unit head 7 in the parallel arrangement direction of the unit heads 7. In addition, the upper surface of the fixation member 33 is brought into contact with the ceiling 28, thereby defining a position of the unit head 7 in the height direction. Further, the reference part 60 of the fixation member 33 is brought into contact with the installation surface 25, thereby defining a position of the unit head 7 in the thickness direction of the base plate 23. In a state in which the positions of the unit head 7 are defined as described above, screws are inserted into the screw holes 29 through the through-holes 64 so as to fix the unit head 7 to the base plate 23. Furthermore, a necessary number of unit heads 7 are fixed to the base plate 23, thereby completing the head unit 2. Moreover, a pin may be provided to protrude from one of the upper surface of the fixation member and the ceiling of the storage section of the base plate toward the other thereof. A pin hole into which the pin can be inserted may be opened at the other part corresponding to the pin, so that the fixation member may be fixed to the base plate in a state in which the pin is inserted into the pin hole.

As described above, the fixation member 33 includes the fixation surface 59 to which the unit head main body 32 is fixed. The fixation member 33 also includes the reference surface 58 that is formed on a side opposite the fixation surface 59 and includes the reference part 60 serving as a positioning reference for an installation target of the unit head main body 32. The fixation member 33 also includes the adhesive 34 for adjusting (controlling) a relative position between the reference surface 58 and the nozzle strings 42 and is provided between the unit head main body 32 and the fixation surface 59. Therefore, it is possible to create the unit head 7 in which a relative position between the reference surface 58 and the unit head main body 32 is adjusted (defined) in advance. For this reason, when the unit head 7 is fixed to the base plate 23, a relative position of the reference surface 58 for the base plate 23 is precisely defined. Thus, it is possible to define a relative position of the unit head main body 32 with high accuracy. As a result, the effort to check a positional deviation of the unit head main body 32 fixed to the base plate 23 is not necessary, and thus it is possible to improve workability when installing the unit head 7 in the base plate 23.

In addition, a relative position of the nozzle strings 42 and the reference surface 58 is adjusted on the basis of the alignment patterns A formed on the landing target by ejecting the ink from each nozzle 44 of the unit head main body 32. Therefore, it is possible to adjust a position of the unit head main body 32 in consideration of ink ejecting characteristics (for example, the skew of ink droplets during flight or the like) of the unit head main body 32. For this reason, it is possible to define a relative position of the unit head main body 32 for the base plate 23 with higher accuracy. Further, a relative position of the nozzle strings 42 is adjusted so that the linear alignment patterns A (formed on the landing target by ejecting the ink from the nozzle strings 42 in the direction along the reference surface 58) is parallel to the reference surface 58. Therefore, it becomes easier to adjust a relative position between the reference surface 58 and the nozzle strings 42. Furthermore, the term "parallel" mentioned here includes a case of being slightly shifted from a parallel state within an allowable error margin of the specifications of the product. Moreover, the installation surface 25 is in contact with the reference part 60, and thus positions of the base plate 23 and the fixation member 33 are determined. Accordingly, it is possible to easily define a relative position of the unit head main body 32 and the base plate 23. As a result, it is possible to further improve accuracy when installing the unit head in the base plate 23.

Figure 10:
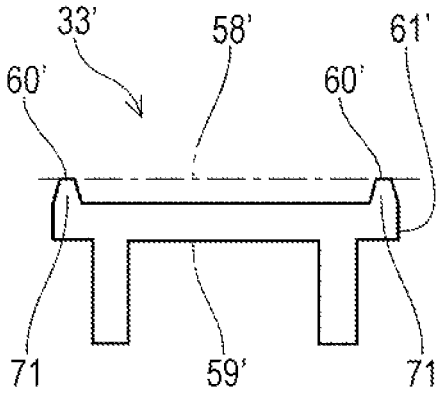
FIG. 10 is a bottom view of a fixation member in another embodiment.

However, a configuration of the reference part 60 of the fixation member 33 is not limited to the above-described embodiment, and a configuration may be employed in which the reference part protrude on a side opposite the fixation surface. For example, in another embodiment illustrated in FIG. 10, protrusions 71 which protrude toward the base plate 23 side are provided at positions opposing the installation surface 25 of a fixation member 33' in the height direction of the fixation member 33'. The protrusions 71 are provided at both ends of a plate-shaped part 61' in the width direction, and front end surfaces of both the protrusions 71 are reference parts 60' that are in contact with the installation surface 25. In addition, in this case, a virtual plane (the dot chain line in FIG. 10) including the front end surfaces of both the protrusions 71 is a reference surface 58'. In other words, a surface of the plate-shaped part 61' opposing the vacancy 26 is in a state of being depressed further toward the fixation surface 59' side than the reference surface 58'. In this way, the vacancy 26 of the base plate 23 is not necessary that is provided so that parts other than the fixation member 33' are not brought into contact with other parts of the base plate 23 in a state in which the reference part 60' of the fixation member 33' is brought into contact with the installation surface 25 of the base plate 23. Accordingly, it is possible to further increase a thickness of the base plate 23 and to thus increase the strength of the base plate 23. In addition, if an area of the front end surfaces of the protrusions 71 is made as small as possible, plane processing of the front ends requiring high flatness becomes easier. Further, other configurations are the same as those in the above-described embodiment, and thus description thereof will not be repeated.

A configuration may be employed in which the reference part of the fixation member is depressed from the plate-shaped part (a surface on the base plate side) to the fixation surface side (a side opposite the installation surface). In other words, the part of the fixation member opposing the vacancy is disposed further toward the base plate side than the reference part. For example, in a thickness direction (a thickness direction of the base plate, or a direction perpendicular to the installation surface) of the unit head (fixation member), a plate-shaped (flange-shaped) fixation part may extend outwardly from the middle (for example, a central portion) of the partition wall (fixation member), and a surface on an installation surface side of the fixation part may be used as a reference part. In this case, a virtual plane including the reference part that is a reference surface is disposed in the middle of the unit head (fixation member) in the thickness direction. With this configuration, when the unit head is installed in the storage section of the base plate, a part of the unit head is disposed further inward than the reference surface. In other words, a part of the unit head is stored in the vacant part of the storage section. In this way, it is possible to reduce a gap between the unit heads disposed on both sides with the base plate interposed therebetween. In addition, it is desirable to set a depth of the vacancy in consideration of a manufacturing tolerance so that a part of the unit head stored in the vacancy of the storage section is not in contact with the inner wall surface inside the vacancy.

In addition, in the above-described embodiment, a total of eight unit heads 7 are installed in both sides of the base plate 23, but the invention is not limited thereto. In other words, at least one unit head may be installed in the base plate. In addition, the two nozzle strings 42 are provided on the nozzle surface 45 of the unit head main body 32, but the invention is not limited thereto. For example, one nozzle string or three or more nozzle strings may be provided on the nozzle surface. Further, in the above-described embodiment, the alignment patterns A are adjusted so as to be parallel to the reference lines B that are adjusted so as to be parallel to the reference surface 58, but the invention is not limited thereto. For example, the alignment patterns are adjusted so as to be parallel to reference lines that are tilted with respect to a reference surface, and thus it is possible to adjust the nozzle string so as to be tilted with respect to the reference surface. In this way, the nozzle string is tilted with respect to a paper surface direction of recording paper, and thus it is possible to reduce a nozzle pitch in the same direction and to therefore increase a resolution.

In addition, in the above-described embodiment, the ink is ejected from the unit head main body 32 so as to record the alignment patterns on the landing target, and a relative position between the reference surface 58 and the nozzle string 42 is indirectly adjusted by adjusting a relative position between the alignment patterns and the reference lines. However, the invention is not limited thereto. For example, the alignment patterns may not be recorded, and a relative position between the reference surface and the nozzle strings may be adjusted using the actual nozzle strings formed on the nozzle surface. For example, a glass mask on which reference lines whose relative position with a reference surface has been adjusted (defined) are drawn may be brought into contact with the nozzle surface, and a relative position between the reference lines and the nozzle strings may be adjusted so that the reference lines and the nozzle strings are parallel to each other, while checking the relative position. Further, in the above-described embodiment, a so-called bending vibration type piezoelectric element 51 has been exemplified as pressure generation means, but the invention is not limited thereto, and, for example, a so-called longitudinal vibration type piezoelectric element or a heater element may be used.

In the above-described embodiment, the ink jet recording head mounted in an ink jet printer has been exemplified, but the invention is applicable to heads that eject liquids other than ink. For example, the invention is applicable to a color material ejecting head that is used to manufacture color filters for a liquid crystal display or the like, an electrode material ejecting head that is used to form electrodes of an organic electroluminescence (EL) display or a field emission display (FED), a living organic matter ejecting head that is used to manufacture a biochip (biotip), and the like.

The entire disclosure of Japanese Patent Application No: 2013-063724, filed Mar. 26, 2013 is expressly incorporated by reference herein in its entirety.

What is claimed is:

1. A method of manufacturing a liquid ejecting head unit including a liquid ejecting head that is provided with a liquid ejecting head main body that has a nozzle group that is formed by arranging a plurality of nozzles, which eject a liquid, in parallel, to eject a liquid from each nozzle, and a fixation member that has a fixation part to which the liquid ejecting head main body is fixed, and a reference surface that is formed on a side opposite the fixation part, the reference surface includes a reference part serving as a reference for positioning the liquid ejecting head main body with respect to an installation target; and a support member that has an installation surface in which the liquid ejecting head is installed using the fixation member, the method comprising:

adjusting the relative position between dots in line to be formed by the nozzle group of the liquid ejecting head main body and the reference surface of the fixation member;

fixing the fixation member and the liquid ejecting head main body by positioning a position adjusting part between the liquid ejecting head main body and the fixation part in a state in which the nozzle group has been positioned with respect to the reference surface; and fixing the support member and the fixation member to each other in a state of being positioned with respect to the support member by bringing the reference part of the fixation member into contact with the installation surface of the support member.

2. The method of manufacturing a liquid ejecting head unit according to claim 1, wherein the adjusting of the relative position includes:

forming a pattern on a landing target by ejecting a liquid from each nozzle of the liquid ejecting head main body; and adjusting the relative position of the nozzle group with respect to the reference surface based on the pattern.

3. The method of manufacturing a liquid ejecting head unit according to claim 2, wherein the adjusting the relative position of the nozzle group comprises adjusting the nozzle group so the plurality of nozzles are aligned with a linear pattern, with the nozzle group being parallel to the linear pattern.

4. The method of manufacturing a liquid ejecting head unit according to claim 1, further comprising:

injecting the positioning adjusting part between the liquid ejecting head main body and the fixation member to both position the nozzle group with respect to the reference surface and mount the liquid ejecting head main body to the fixation member.

5. The method of manufacturing a liquid ejecting head unit according to claim 4, further comprising:

injecting the positioning adjusting part between a gap disposed between the liquid ejecting head main body and at least one of the fixation part and the reference surface of the fixation member.

6. The method of manufacturing a liquid ejecting head unit according to claim 1, further comprising:

tilting the liquid ejecting head main body relative to the reference surface to align the nozzle group.

7. The method of manufacturing a liquid ejecting head unit according to claim 6, wherein tilting the liquid ejecting head main body comprises:

positioning the fixation member within a first jig;

mounting the liquid ejecting head main body to a second jig; and tilting the first jig relative to the second jig.

8. The method of manufacturing a liquid ejecting head unit according to claim 1, wherein bringing the reference part of the fixation member into contact with the installation surface of the support member further comprises locating a plate-shaped part of the fixation member in relation to a pair of receiving surfaces of a storage section formed in the support member.

9. The method of manufacturing a liquid ejecting head unit according to claim 8, wherein the storage section comprises the pair of receiving surfaces and a vacancy between the pair of receiving surfaces, the plate-shaped part of the fixation member being only in contact with the pair of receiving surfaces.

* * * * *